US011313142B1

(12) United States Patent
Fife

(10) Patent No.: US 11,313,142 B1
(45) Date of Patent: Apr. 26, 2022

(54) SWIMMING POOL LEVELING SYSTEM AND METHOD OF USE

(71) Applicant: Taylor Fife, Santa Cruz, CA (US)

(72) Inventor: Taylor Fife, Santa Cruz, CA (US)

( * ) Notice: Subject to any disclaimer, the term of this patent is extended or adjusted under 35 U.S.C. 154(b) by 0 days.

(21) Appl. No.: 17/138,619

(22) Filed: Dec. 30, 2020

Related U.S. Application Data

(63) Continuation-in-part of application No. 16/508,988, filed on Jul. 11, 2019, now Pat. No. 10,942,531.

(60) Provisional application No. 62/697,633, filed on Jul. 13, 2018.

(51) Int. Cl.
*E04H 4/12* (2006.01)

(52) U.S. Cl.
CPC ..... *E04H 4/12* (2013.01); *Y10T 137/731* (2015.04); *Y10T 137/7358* (2015.04)

(58) Field of Classification Search
CPC ..... E04H 4/12; E04H 4/14; G05D 7/0166; G05D 9/12; F16K 31/18; F16K 31/20; F16K 31/22; F16K 31/30; F16K 33/00; Y10T 137/731; Y10T 137/7358
See application file for complete search history.

(56) References Cited

U.S. PATENT DOCUMENTS 2,842,158 A * 7/1958 Robinson ..... F16K 31/22 137/428
3,176,707 A * 4/1965 Wilson ..... A01K 7/04 137/315.08
3,739,405 A ‡ 6/1973 Schmidt ..... E04H 4/12 4/508
3,837,015 A ‡ 9/1974 Whitaker ..... G05D 9/02 4/508
3,848,616 A ‡ 11/1974 Sanner ..... G01F 23/241 137/78.5
3,848,627 A ‡ 11/1974 Page ..... G01F 23/241 137/392
3,893,470 A ‡ 7/1975 MacPhee ..... G05D 9/12 137/101.27
3,908,206 A ‡ 9/1975 Grewing ..... E04H 4/12 4/508
3,997,925 A ‡ 12/1976 Hough ..... E04H 4/12 4/508
4,069,405 A ‡ 1/1978 Fima ..... G01F 23/70 200/84 C (Continued)

FOREIGN PATENT DOCUMENTS

GB 2302162 A ‡ 1/1997 ..... E04H 4/12

*Primary Examiner* — Craig M Schneider
*Assistant Examiner* — Frederick D Soski
(74) *Attorney, Agent, or Firm* — Leavitt Eldredge Law Firm

(57) ABSTRACT

A swimming pool leveling system includes a bracket extending from a first end to a second end, the bracket having openings; a float valve having a body with a float positioned within an interior of the body, the float valve engaged with the bracket via an adjustment device; a pressure reducing valve engaged with the body and to receive a water source; and a base having a base body with an enclosed interior accessible via an opening, the enclosed interior configured to receive a weight, the base engaging with the bracket via one or more securement devices; the base is to rest on a surface such that the bracket extends the float valve into a pool; and the float valve to allow filling of the pool to a desired height.

5 Claims, 11 Drawing Sheets

(56) References Cited

U.S. PATENT DOCUMENTS 4,080,985 A ‡ 3/1978 Eagle ..... F16K 31/18 137/386
4,194,691 A ‡ 3/1980 Birnbach ..... A01G 25/167 239/63
4,227,266 A ‡ 10/1980 Russell ..... E04H 4/12 137/362
4,265,598 A ‡ 5/1981 Brand ..... E04H 4/12 200/84 R
4,342,125 A ‡ 8/1982 Hodge ..... E04H 4/12 137/430
4,361,038 A ‡ 11/1982 Schuler ..... G01F 23/22 137/392
4,380,091 A ‡ 4/1983 Lively ..... E04H 4/12 137/386
4,418,569 A ‡ 12/1983 Kuhnel ..... G01F 23/266 324/678
4,491,146 A ‡ 1/1985 Sveds ..... F22B 1/284 137/341
4,574,405 A ‡ 3/1986 Tams ..... E04H 4/12 137/428
4,586,532 A * 5/1986 Tsolkas ..... F16K 31/24 119/79
4,591,839 A ‡ 5/1986 Charboneau ..... G01F 23/246 340/620
4,592,098 A ‡ 6/1986 Magnes ..... E04H 4/12 137/389
4,655,243 A ‡ 4/1987 Keller ..... E04H 4/1218 137/403
4,686,718 A ‡ 8/1987 Kinkead ..... E04H 4/1209 137/428
4,706,310 A ‡ 11/1987 Magnes ..... E04H 4/1272 4/508
4,724,552 A ‡ 2/1988 Kinkead ..... E04H 4/1209 4/508
4,735,230 A ‡ 4/1988 Detloff ..... E03D 1/00 137/15.26
4,823,987 A ‡ 4/1989 Switall ..... B01F 3/088 137/101.25
4,853,986 A ‡ 8/1989 Allen ..... E04H 4/12 4/508
4,888,989 A ‡ 12/1989 Homer ..... G01F 23/266 73/304 C
5,035,583 A ‡ 7/1991 Vaught ..... F04D 9/041 417/200
5,103,368 A ‡ 4/1992 Hart ..... G01F 23/268 361/284
5,154,205 A ‡ 10/1992 Langill ..... E04H 4/12 137/393
5,203,038 A ‡ 4/1993 Gibbs ..... E04H 4/12 4/508
5,253,374 A ‡ 10/1993 Langill ..... G05D 9/12 239/407
5,315,873 A ‡ 5/1994 Jin ..... G01F 23/003 73/309
5,365,617 A ‡ 11/1994 Tarr ..... E04H 4/12 137/392
5,367,723 A ‡ 11/1994 Pleva ..... E04H 4/12 137/428
5,427,136 A ‡ 6/1995 Weishew ..... B41F 31/022 101/364
5,459,886 A ‡ 10/1995 Payne ..... E04H 4/1209 137/414
5,596,773 A ‡ 1/1997 Cueman ..... E04H 4/12 4/496
5,624,238 A ‡ 4/1997 Herbert ..... A62C 25/00 417/234
5,655,232 A ‡ 8/1997 Buckwaiter ..... E04H 4/12 137/403
5,730,861 A ‡ 3/1998 Sterghos ..... B01D 21/0012 210/86
5,790,991 A ‡ 8/1998 Johnson ..... E04H 4/12 137/423
5,836,022 A ‡ 11/1998 Busenga ..... E04H 4/12 4/508
5,878,447 A ‡ 3/1999 Mogab ..... E04H 4/12 4/508
5,975,102 A ‡ 11/1999 Schalk ..... G01F 23/2965 137/2
5,992,447 A ‡ 11/1999 Miller ..... E04H 4/12 137/386
6,000,425 A ‡ 12/1999 Steinorth ..... E04H 4/12 137/391
6,006,605 A ‡ 12/1999 Sulollari ..... G01F 23/36 73/306
6,035,879 A ‡ 3/2000 Campbell ..... E03D 1/32 137/15.08
6,223,359 B1 ‡ 5/2001 Oltmanns ..... E04H 4/12 137/392
6,532,814 B2 ‡ 3/2003 Bromley ..... G01M 3/3245 73/290 R
6,611,968 B1 ‡ 9/2003 Swanson ..... E04H 4/12 239/20
6,625,824 B1 ‡ 9/2003 Lutz ..... E04H 4/12 137/625.21
6,826,787 B2 * 12/2004 Gregory ..... G05D 9/02 4/508
6,964,278 B2 ‡ 11/2005 Tschanz ..... G01F 23/02 137/386
7,003,817 B1 ‡ 2/2006 Pansini ..... E04H 4/12 137/426
7,249,506 B2 ‡ 7/2007 Scardovi ..... G01F 23/261 324/663
7,343,794 B1 ‡ 3/2008 Pucel ..... G01F 1/002 73/215
7,481,105 B2 ‡ 1/2009 Schillinger ..... G01F 23/2962 73/290 B
7,690,054 B1 ‡ 4/2010 Pansini ..... E04H 4/12 4/508
7,959,273 B2 ‡ 6/2011 Yajima ..... B41J 2/17566 347/86
8,209,794 B1 ‡ 7/2012 Harrison ..... G05D 9/12 4/508
8,220,482 B1 ‡ 7/2012 DeVerse ..... G01M 3/3245 137/412
8,266,737 B1 ‡ 9/2012 Goettl ..... E04H 4/12 4/508
8,770,218 B2 ‡ 7/2014 Tagami ..... F16K 31/18 137/202
9,068,369 B1 ‡ 6/2015 Goettl ..... E04H 4/00
9,410,336 B2 ‡ 8/2016 DeVerse ..... E04H 4/12
10,337,201 B2 * 7/2019 Thomson ..... F16K 21/185
10,711,474 B1 ‡ 7/2020 Rickerson ..... E04H 4/12
2003/0221250 A1 ‡ 12/2003 Gibson ..... E04H 4/12 4/508
2004/0035465 A1 ‡ 2/2004 Cazden ..... E04H 4/12 137/392
2004/0187203 A1 ‡ 9/2004 Gibson ..... E04H 4/12 4/508
2004/0205885 A1 ‡ 10/2004 Gardner ..... E04H 4/12 4/507
2006/0070174 A1 ‡ 4/2006 Pansini ..... E04H 4/12 4/507
2006/0096659 A1 ‡ 5/2006 Reusche ..... A01K 7/02 141/198
2008/0144238 A1 ‡ 6/2008 Cline ..... A61H 33/60 361/42
2009/0151796 A1 ‡ 6/2009 Buchtel ..... F16K 31/26 137/434
2009/0165202 A1 ‡ 7/2009 Morrison ..... E04H 4/12 4/508
2009/0260149 A1 ‡ 10/2009 Booth ..... E04H 4/14 4/508
2010/0071123 A1 ‡ 3/2010 Larsen ..... E04H 4/12 4/508
2010/0314328 A1 ‡ 12/2010 Bizon ..... E03D 1/30 210/744
2011/0120219 A1 ‡ 5/2011 Barlesi ..... G01F 23/268 73/304 C

(56) References Cited

U.S. PATENT DOCUMENTS

| | | | | |
|---|---|---|---|---|
| 2011/0185808 | A1‡ | 8/2011 | Arndt | G01F 23/266 73/304 C |
| 2013/0247293 | A1‡ | 9/2013 | Jeronimus | E04H 4/14 4/508 |
| 2015/0211248 | A1‡ | 7/2015 | Nicol | E04H 4/12 4/507 |
| 2015/0227145 | A1‡ | 8/2015 | Reddy | B05B 17/08 137/391 |
| 2018/0065839 | A1‡ | 3/2018 | Hogshead | F16K 21/18 |
| 2020/0131792 | A1‡ | 4/2020 | Litteral | F16K 31/18 |

* cited by examiner
‡ imported from a related application

SWIMMING POOL LEVELING SYSTEM AND METHOD OF USE

BACKGROUND

1. Field of the Invention

The present invention relates generally to swimming pools, and more specifically, to a pool leveling system that provides for automatic shut off of a water source for convenient pool filling to a desired level.

2. Description of Related Art

Pools are well known in the art and are effective means of entertainment and recreation. It is a common that pools require the user to add water from time to time to make up for water loss. A common practice is shown in FIG. 1, flowchart 101, wherein the pool loses water due to evaporation and water being splashed out, or alternatively the pool requires initial filling, as shown with box 103. The user can then proceed to add water via a hose or other water source, as shown with box 105. The user then turns the water off when a desired level is reached, as shown with boxes 107, and 109.

One of the problems commonly associated with system 101 is inaccuracy and inefficiency. For example, the user must either monitor the water source constantly to turn off when the desired level is reached, or they may risk the water overflowing.

Accordingly, although great strides have been made in the area of pool filling systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
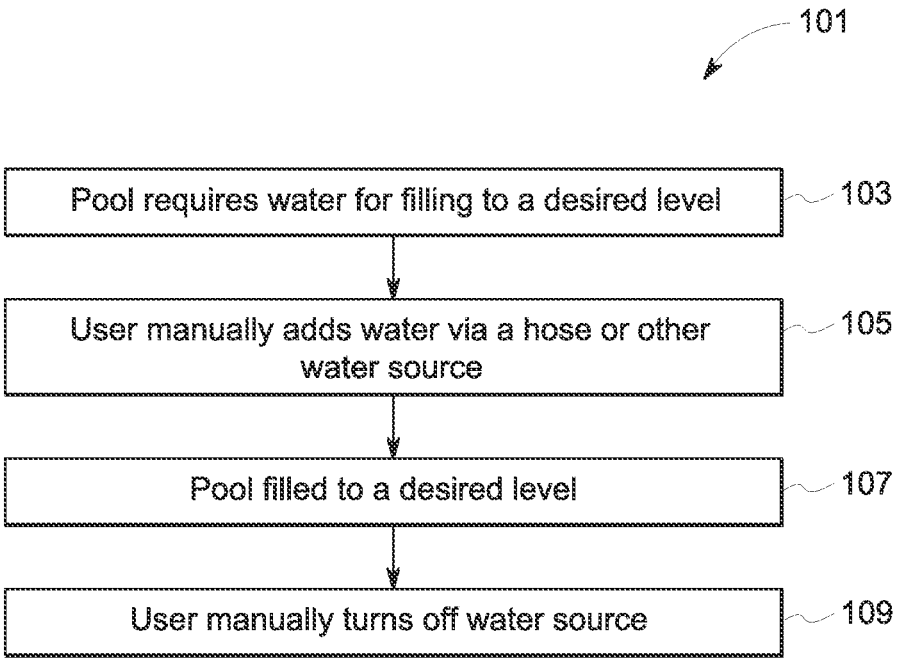
FIG. 1 (PRIOR ART)
FIG. 1 is a flowchart of a common method of adding water to a pool.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional pool filling systems. Specifically, the present invention provides for a convenient pool filling system that uses a float valve to shut off the water as needed to maintain a desired height. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
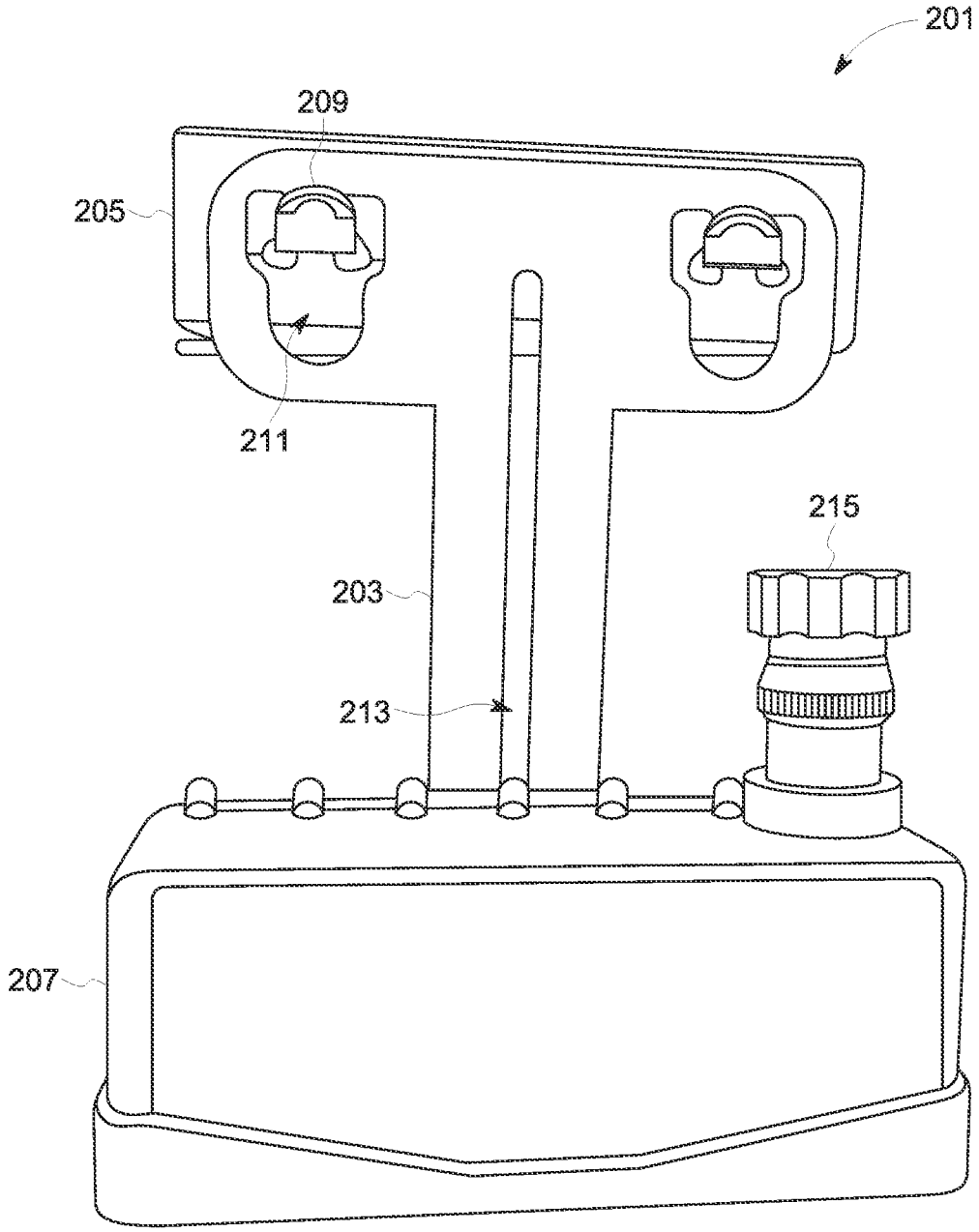
FIG. 2 is a front view of a swimming pool leveling system in accordance with a preferred embodiment of the present application.

Referring now to the drawings wherein like reference characters identify corresponding or similar elements throughout the several views, FIG. 2 depicts a front view of a swimming pool leveling system 201 in accordance with a preferred embodiment of the present application. It will be appreciated that system 201 overcomes one or more of the above-listed problems commonly associated with conventional pool filling systems.

In the contemplated embodiment, system 201 includes a bracket 203 configured to attach to a base 205 and a float valve 207. As shown, in one embodiment, the bracket 203 engaged with one or more knobs 209 that extend from an exterior surface of the base 205 and connect with one or more openings 211 through the bracket. The bracket 203 further including a channel 213 that extends through a thickness of the bracket and provides for adjustability, as will be discussed herein. In the preferred embodiment, a pressure relief valve 215 is configured to connect to a water source, such as a hose.

Figure 3:
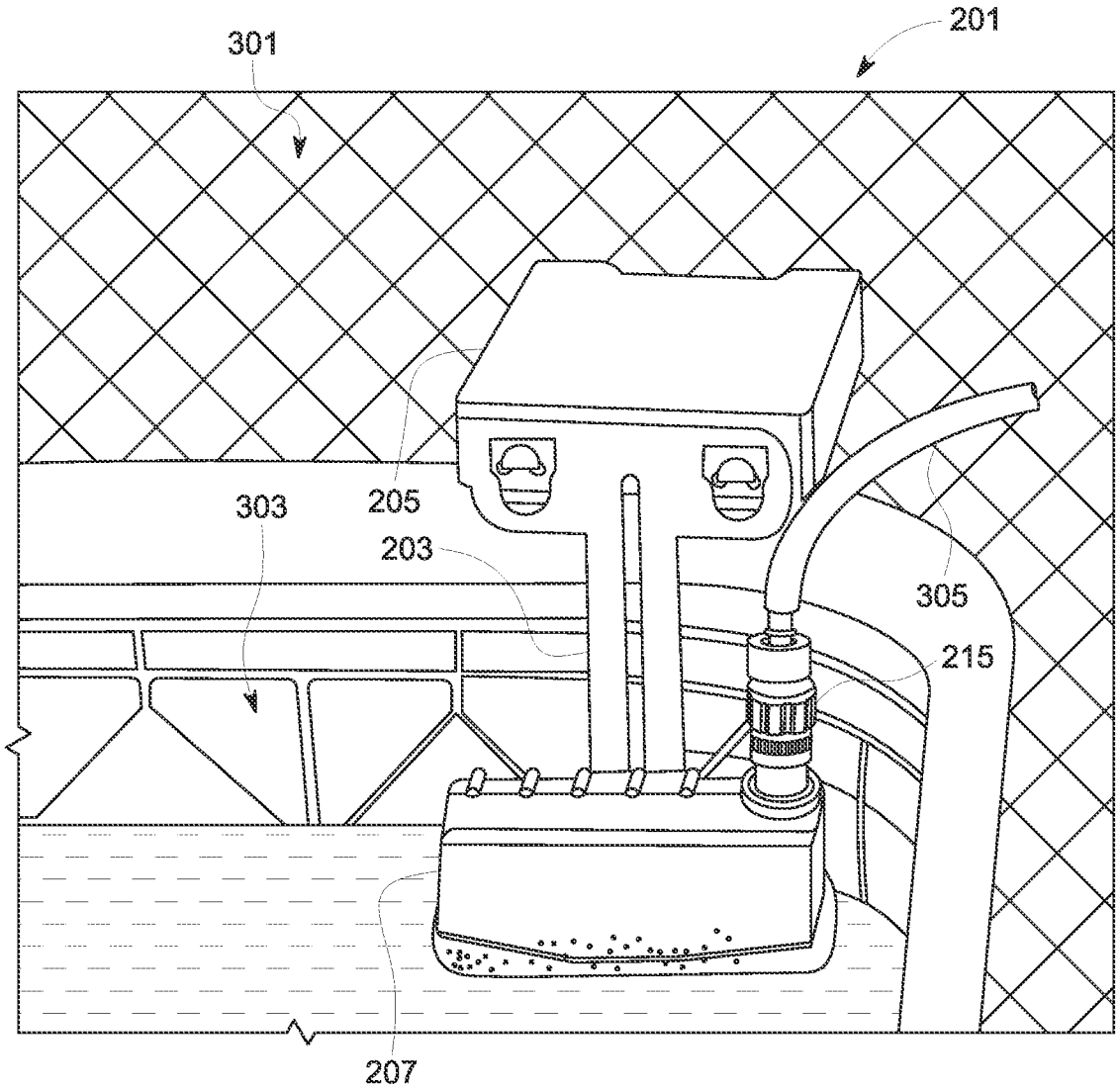
FIG. 3 is an isometric view of the system of FIG. 2 engaged with a water source and a pool in accordance with the present application.

As shown in FIG. 3, the base 205 is configured to rest on a ground surface 301, such that the bracket 203 extends the float valve 207 into the pool 303. A hose 305 is configured to connect to the pressure relief valve 215 to fill the pool to a desired level.

Figure 4:
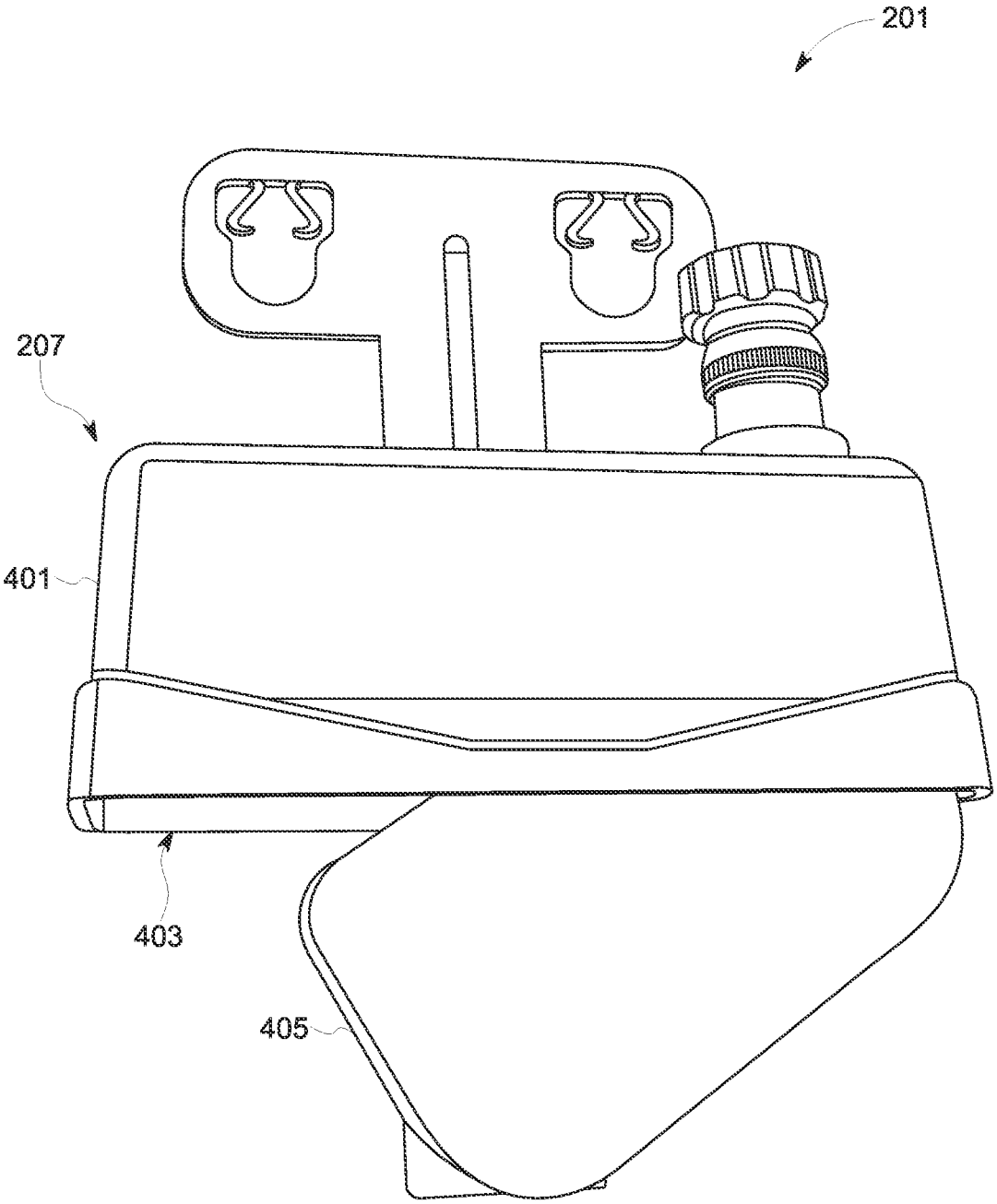
FIG. 4 is an isometric view of the float valve of FIG. 2.

In FIG. 4, the float valve 207 is shown in better detail. As shown, the float valve 207 includes a body 401 that creates an interior area 403 wherein the float 405 is housed.

Figure 5:
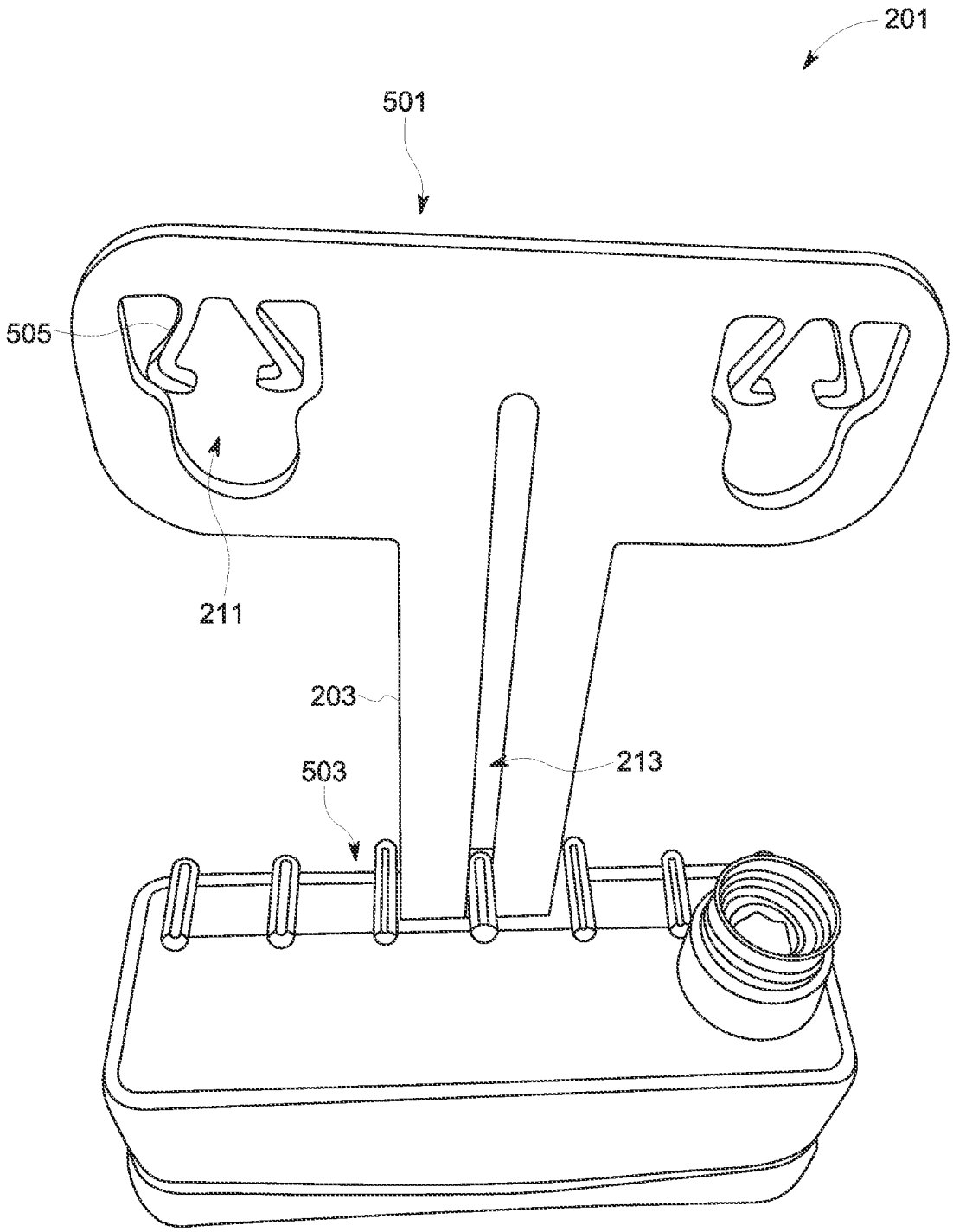
FIG. 5 is a top isometric view of the bracket of FIG. 2.

In FIG. 5, the bracket 203 is shown in more detail. The bracket 203 extending from a first end 501 to a second end 503, wherein the first end 503 includes the one or more openings 211. As shown, in the preferred embodiment, each opening contains a triangular shaped clip 505 configured to releasably engage with the knobs of the base, thereby providing for easy attachment of the bracket to the base.

Figure 6:
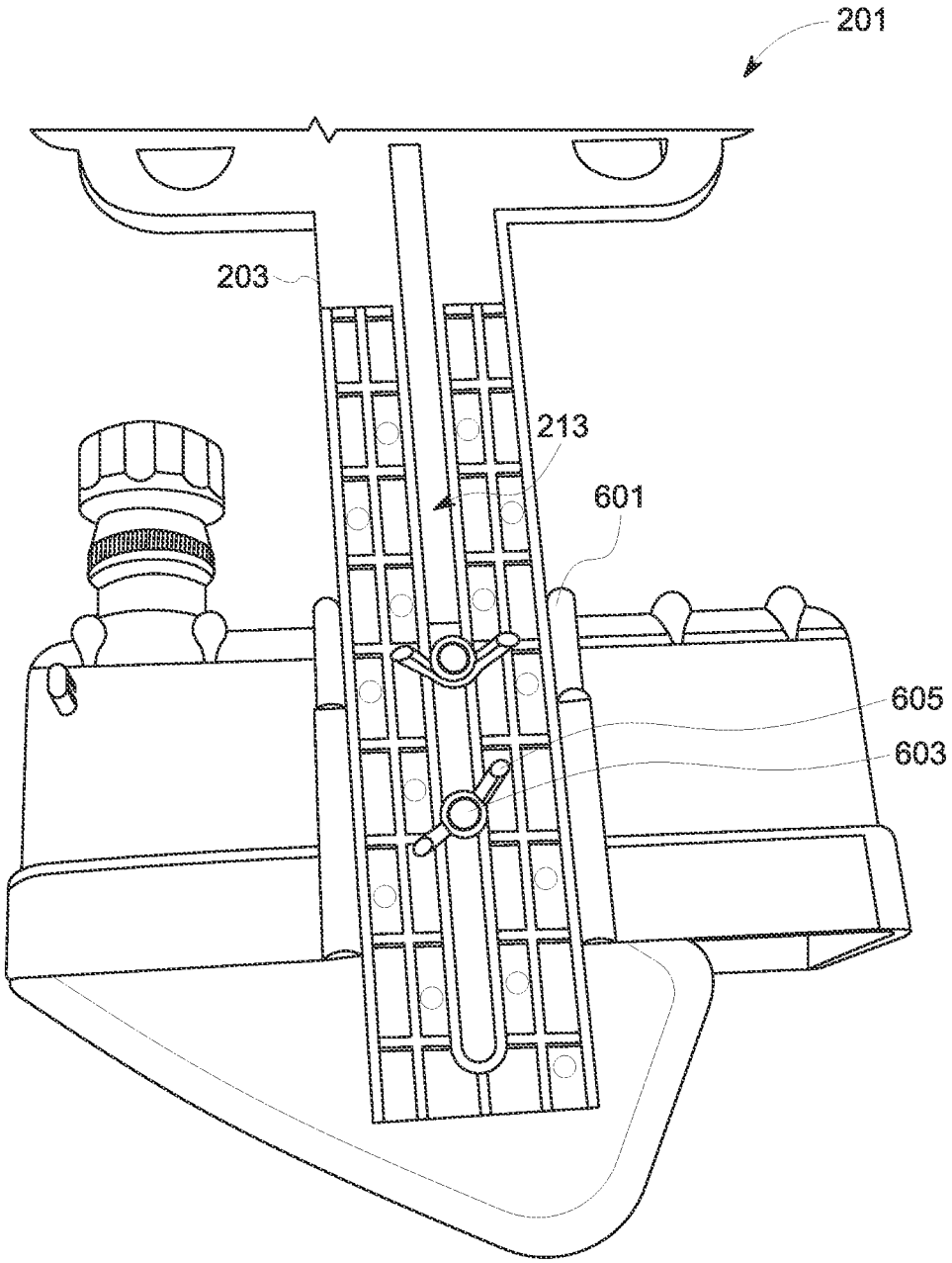
FIG. 6 is a back view of the bracket engaging with the float valve of FIG. 2.

In FIG. 6, the adjustment device 601 configured to adjust a position of the float valve relative to the bracket 203 is shown. The adjustment device 601 can include one or more bolts 603 extending from a surface of the float valve body and configured to extend through the channel 213 and secure in place via one or more nuts 605. It should be appreciated that various other configurations could be used.

Figure 7:
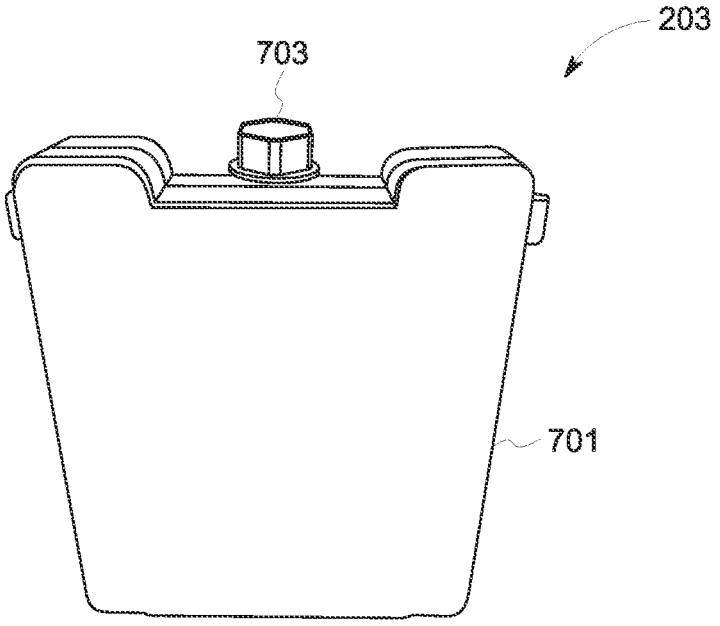
FIG. 7 is a top view of the base of FIG. 2.

In FIG. 7, a top view depicts base 205. As shown, the base 205 includes a base body 701 with an enclosed interior area accessible via an opening 703. The base 205 is configured to receive a weight, such as water or sand, thereby weighing down the system.

Figure 8:
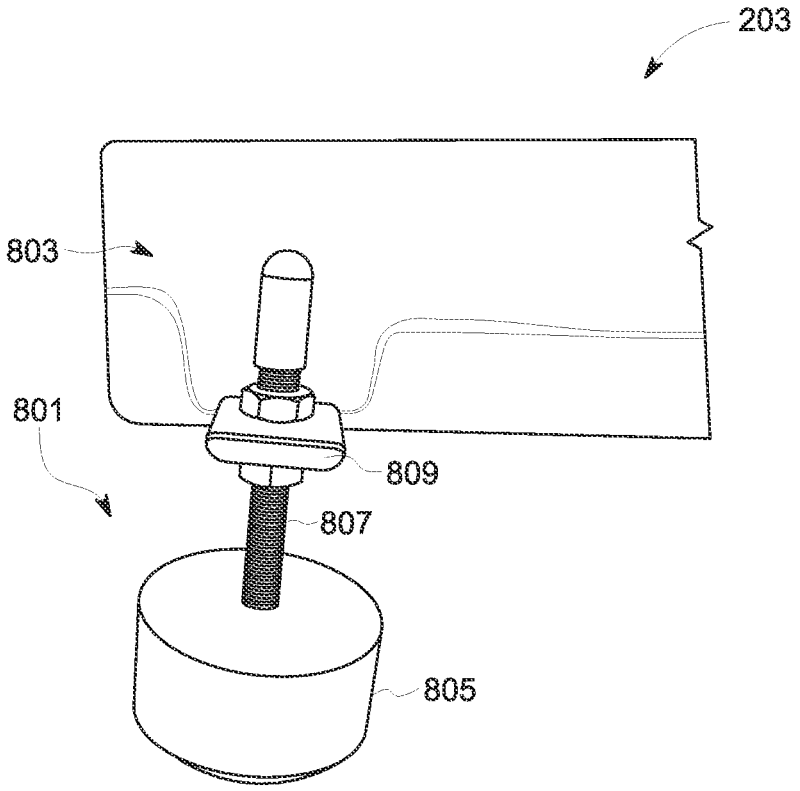
FIG. 8 is a back view of the base of FIG. 2.

In FIG. 8, a back view depicts an adjustable foot 801 attached to a side 803 of the base 203. As shown, the adjustable foot 801 can include a foot portion 805 attached to a threaded rod 807 which extends through a lip 809. The user can use the one or more feet of the system to raise and lower an end of the base. This feature allows for the user to level the base relative to the surface, such as when the surface is sloped away from the pool.

Figure 9:
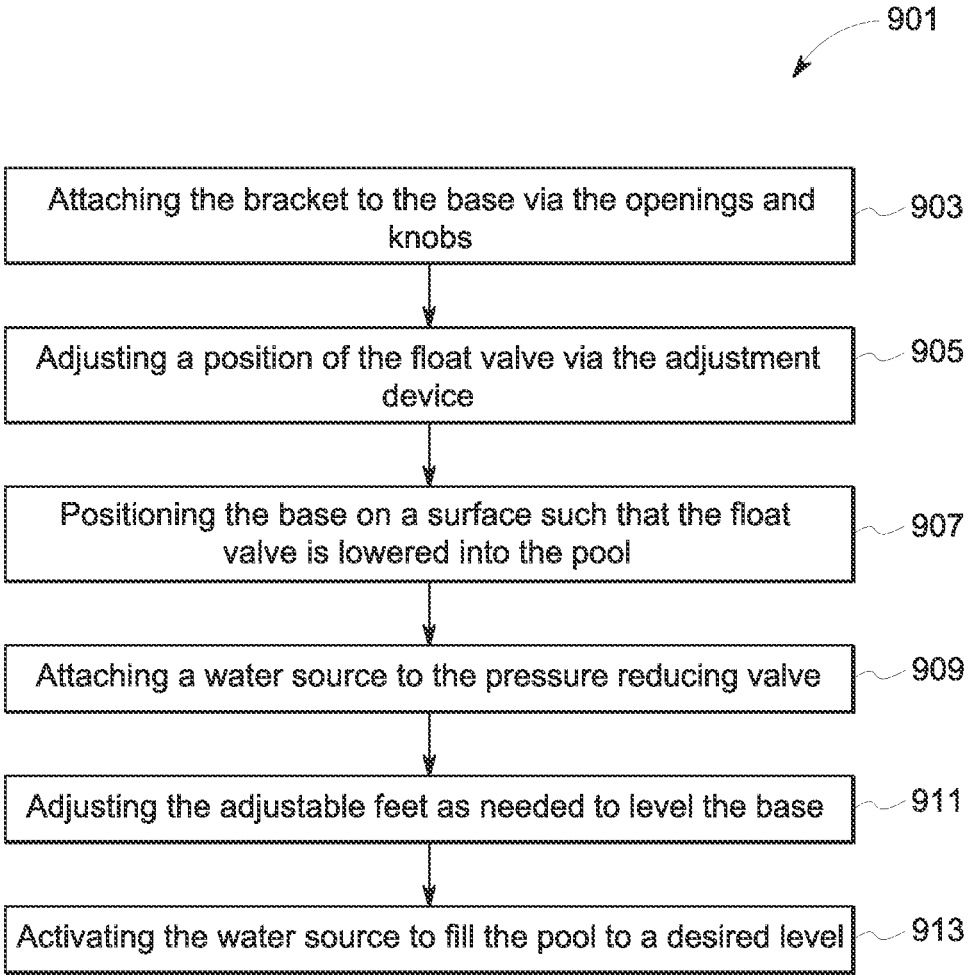
FIG. 9 is a flowchart of the method of use of the system of FIG. 2.

In FIG. 9, a flowchart 901 depicts a method of use of the system 201. During use, the user attaches the bracket to the base and adjusts a position of the float valve as desired, as shown with boxes 903, 905. The base is positioned on a surface such that the float valve is lowered into the pool, as shown with box 907. The user can proceed with attaching a water source to the pressure relief valve and adjusting the feet as necessary to level the base, as shown with boxes 909, 911. The water source is activated to fill the pool to a desired level, as shown with box 913.

Figure 10:
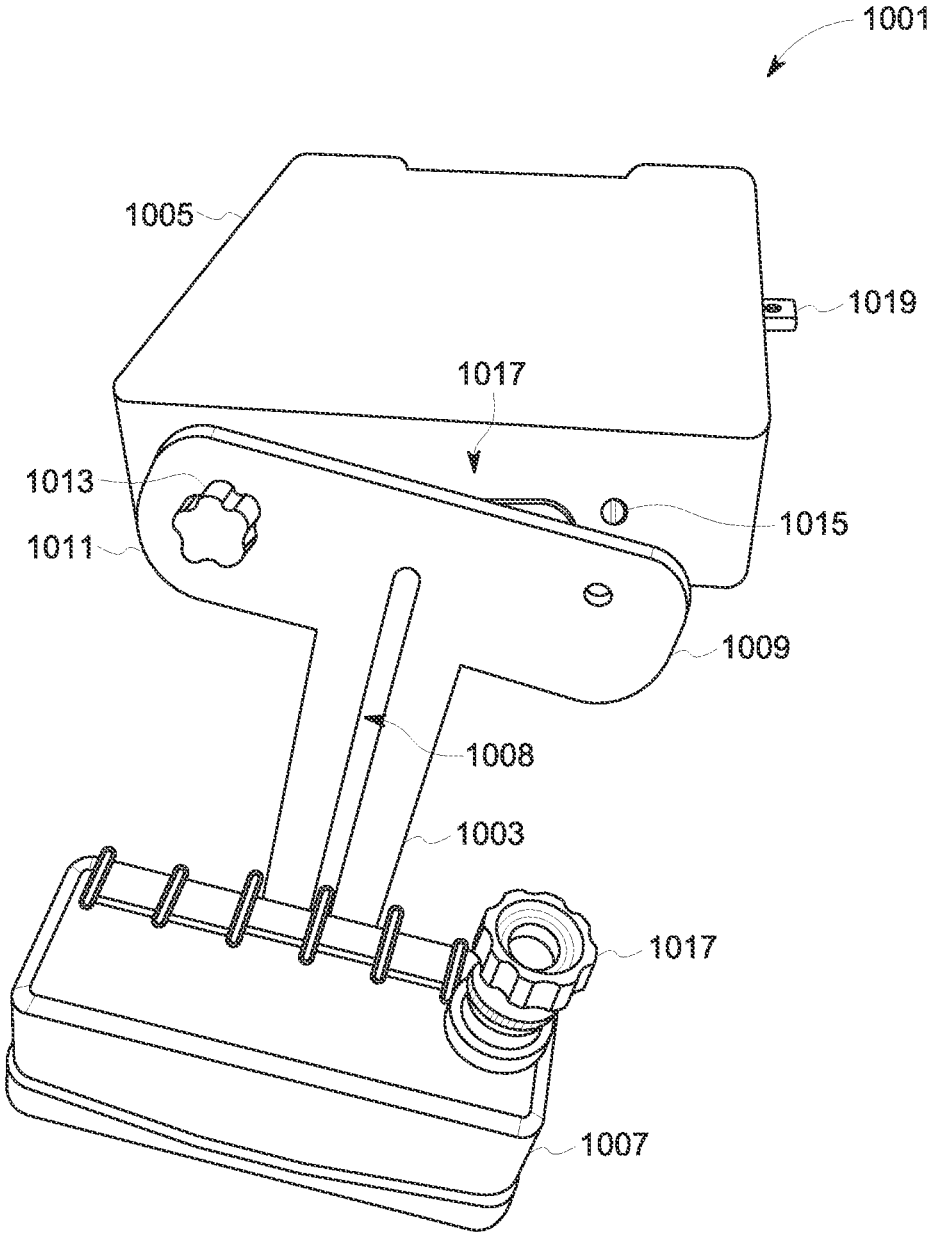
FIG. 10 is a front view of a swimming pool leveling system in accordance with an alternative embodiment of the present application.
Figure 11:
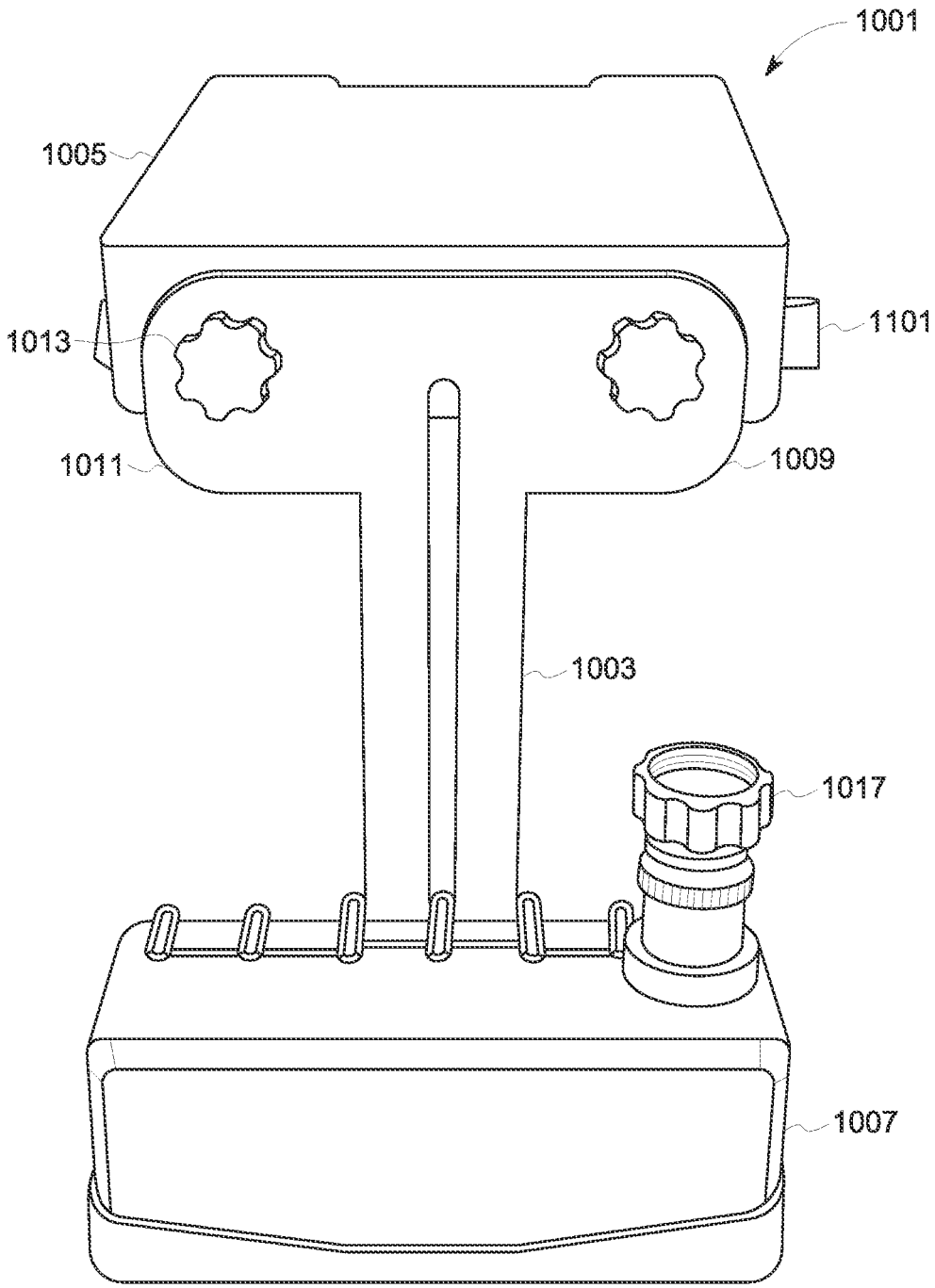
FIG. 11 is a front view of the system of FIG. 10.
Figure 12:
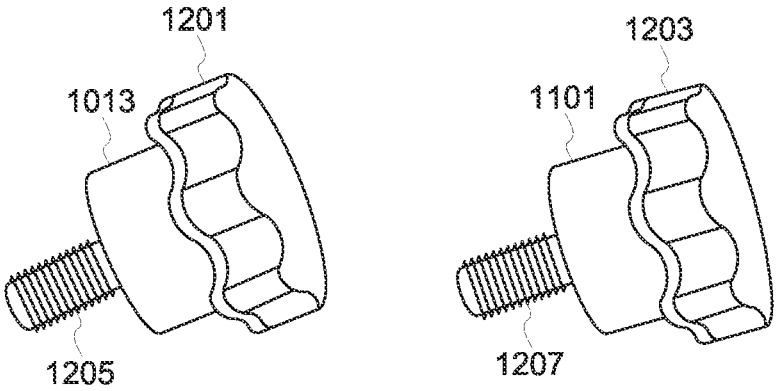
FIG. 12 is an isomeric view of an attachment device of the system of FIG. 10.

In FIGS. 10-12, an alternative embodiment of a swimming pool leveling system is shown. System 1001 may include all of the features discussed above. System 1001 includes a bracket 1003 that extends from a base 1005 to a float valve 1007. As shown, the bracket 1003 may include a channel 1008 for vertical adjustment as shown. The bracket 1003 is in the shape of a "T" and extends to a top portion, having a first side 1009 and a second side 1011. Each side includes a securement device 1013, 1101 which in this embodiment are threaded connectors as shown in FIG. 12. The threaded connectors extend through the bracket and into threaded receivers 1015 within a front surface 1017 of the base. Further shown is the pressure relief valve 1017 and the tab 1019 for attaching an adjustable foot.

In FIG. 11, another front view of system 1001 is shown for clarity, wherein both securement devices 1013, 1101 are secured in place. It should be appreciated that these securement devices provide for a stable connection to secure the bracket to the base such that when there is movement via water, the bracket and base remain secured together.

In FIG. 12, another view of the securement devices 1013, 1101 are shown, wherein each has a cap 1201, 1203 secured to the threaded extender 1205, 1207 to allow for easy use.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A swimming pool leveling system, comprising:

a bracket extending from a first end to a second end, the bracket having at least two openings at the first end;

a float valve having a body with a float positioned within an interior of the body, the float valve engaged with the bracket via an adjustment device at the second end of the bracket;

a pressure reducing valve engaged with the body, which receives water from a water source; and a base having a base body with an enclosed interior accessible via an opening, wherein the enclosed interior receives a weight and wherein a vertical side surface of the base engages with the bracket;

at least two securement devices extending through the at least two openings and into the base to secure the bracket to the vertical side surface of the base;

wherein the base rests on a top surface of a pool such that the bracket extends the float valve into the pool;

wherein the float valve allows filling of the pool to a desired height by shutting off the water source; and wherein the base further comprises one or more adjustable feet, which level the base.

2. The system of claim 1, wherein the adjustment device comprises:

a channel extending through a thickness of the bracket;

one or more bolts extending from a back of the float valve body, the one or more bolts extending through the channel; and one or more nuts securing the bolts within a position along the channel.

3. A method of raising water in a pool, the method comprising:

providing the system of claim 1;

attaching the bracket to the vertical side surface of the base via the at least two openings and the at least two securement devices;

positioning the base on the top surface such that the float valve is lowered into the pool;

attaching the water source to the pressure reducing valve; and activating the water source; and wherein the float valve shuts off the water source when the water reaches the desired height.

4. The method of claim 3, further comprising:

raising an end of the base via the one or more adjustable feet to level the base relative to the top surface.

5. The method of claim 3, further comprising:

adjusting a position of the float valve via the bracket and adjustment device.

* * * * *